US008037724B2

(12) United States Patent
Fox

(10) Patent No.: US 8,037,724 B2
(45) Date of Patent: Oct. 18, 2011

(54) COMBINATION LOCK

(76) Inventor: Arnold Jeffrey Fox, Salford Lancashire (GB)

( * ) Notice: Subject to any disclaimer, the term of this patent is extended or adjusted under 35 U.S.C. 154(b) by 943 days.

(21) Appl. No.: 11/921,879

(22) PCT Filed: Jun. 9, 2006

(86) PCT No.: PCT/GB2006/050147

§ 371 (c)(1),
(2), (4) Date: Dec. 7, 2007

(87) PCT Pub. No.: WO2006/131769

PCT Pub. Date: Dec. 14, 2006

(65) Prior Publication Data

US 2009/0090149 A1 Apr. 9, 2009

(30) Foreign Application Priority Data

Jun. 10, 2005 (GB) ..... 0511817.9

(51) Int. Cl.
*E05B 37/02* (2006.01)

(52) U.S. Cl. ..... 70/289; 70/276; 70/306; 70/305; 70/311; 70/314; 70/329; 70/332

(58) Field of Classification Search ..... 70/276, 70/329–332, DIG. 23, DIG. 25, 286–291, 70/294, 301, 304–314, 320–323
See application file for complete search history.

(56) References Cited

U.S. PATENT DOCUMENTS

| | | | | | |
|---|---|---|---|---|---|
| 619,940 | A | * | 2/1899 | Clarke | 70/294 |
| 900,437 | A | * | 10/1908 | Soley | 70/309 |
| 1,398,617 | A | * | 11/1921 | Yates | 70/307 |
| 1,445,589 | A | * | 2/1923 | Horiguchi | 70/276 |
| 1,577,327 | A | * | 3/1926 | Letourneau | 70/304 |
| 1,585,949 | A | * | 5/1926 | Tueckmantel | 70/66 |
| 1,752,824 | A | * | 4/1930 | Watson | 70/311 |
| 1,853,243 | A | * | 4/1932 | Thor | 70/145 |
| 2,645,925 | A | * | 7/1953 | Miller | 70/149 |
| 2,991,644 | A | * | 7/1961 | Edwards et al. | 70/156 |
| 3,274,810 | A | * | 9/1966 | Traversa et al. | 70/288 |
| 3,356,875 | A | * | 12/1967 | Weismann | 310/104 |
| 3,948,068 | A | * | 4/1976 | Stackhouse | 70/276 |
| 3,967,479 | A | * | 7/1976 | Vick | 70/276 |
| 4,111,014 | A | * | 9/1978 | Epstein | 70/25 |
| 4,718,260 | A | * | 1/1988 | Larking et al. | 70/299 |
| 5,148,692 | A | * | 9/1992 | Gieseker | 70/290 |

FOREIGN PATENT DOCUMENTS

| | | | |
|---|---|---|---|
| DE | 926591 | * | 4/1955 |
| DE | 1249726 | * | 9/1967 |

* cited by examiner

*Primary Examiner* — Lloyd Gall
(74) *Attorney, Agent, or Firm* — Thomas M. Freiburger

(57) ABSTRACT

A combination lock comprises a bolt which is withdrawn by depressing a bolt pin which is shielded by rotating discs having a movable disc pin within them. A selector pin attached to a dial is provided for engaging in selector holes in the discs and aligning the disc pins with one another and with the bolt pin, with provision for pushing inwardly the disc pin on the outer disc and urging the other disc pins aligned therewith towards the bolt pin such that it is depressed and/or withdrawn. The discs have a weight attached at their circumference such that, during code setting, changing the position of the weight changes the relative angular position of the disc pin. When pressure is released from the mechanism, springs return the selector pin and the disc pins to their original positions and the weights on the discs fall, thereby rotating the discs and automatically scrambling the code.

28 Claims, 4 Drawing Sheets

COMBINATION LOCK

TECHNICAL FIELD

This invention relates to combination locks comprising a coded control mechanism to release a locking member from its locked condition. Particularly but not exclusively the present invention relates to a combination lock to control opening of a closure member, e.g. a door, window or the like. However it is envisaged that combination locks according to this invention may be utilised for padlocks and other kinds of lock utilising a coded control mechanism.

BACKGROUND

Combination locks are commonly used to control access to premises and containers and to control release of chains and other locked-up items by controlling the opening of a closure member, but they are not suitable for overall security. So, although such locks may be employed during the day to allow access to people knowing the code, at night the doors are usually locked with a key. This is because such locks generally do not have a sufficiently large number of combinations for the owner to be confident that the code will not be discovered by chance. Furthermore, they are normally operated by pressing buttons and onlookers can see which combination is selected. An additional drawback is that users sometimes forget the code or transpose the digits of the code.

It is therefore considered desirable to devise a combination lock which can overcome or at least minimize these and/or other problems.

SUMMARY OF THE INVENTION

According to one aspect of the present invention there is provided a combination lock comprising a coded control mechanism to release a locking member from its locked condition, wherein the coded control mechanism comprises

- a plurality of rotatable carrier means each comprising a rotatable carrier plate having an arcuate (preferably circular) array of openings centred on the rotational axis,
- each of said openings is selectively engageable by a selector pin that is rotatable by depressible dial means,
- each carrier plate has an aperture therethrough, said apertures being equi-spaced radially from the spindle axis,
- an insert in each said aperture is slidable laterally of the associated carrier plate and is expressible laterally from its associated carrier plate when (and only when) all the inserts attain a state in which they are in mutual alignment, the attainment of said state enabling the control mechanism to operate on the locking member and effect its release from the locked condition.

Preferably the rotatable carrier means further comprises a weight located on or adjacent to the periphery of each carrier plate to urge it by gravity towards a rest position in which the weight is lowermost, the position of each weight being selectively variable in relation to the aperture in its associated carrier plate thereby enabling that carrier means to provide one distinctive element of a code and the plurality of carrier means to provide the whole of the selected code.

Advantageously the weights comprise elements of magnetically permeable material and the lock mechanism comprises a permanent magnet beneath the plurality of carrier means to aid the attainment of a rest position with all the weights lowermost. Alternatively, the carrier means may comprise separate elements of magnetically permeable material and the permanent magnet may be located appropriately in relation to them as to ensure the plurality of carrier means attain said rest position with all the weights lowermost.

According to another aspect of the present invention there is provided a combination lock to control opening of a closure member, e.g. a door, window or the like, and comprising a bolt movable from a locking position to a release position and including a bolt actuator part, the combination lock being characterised by

- a plurality of carrier plates mounted rotatably upon a spindle such as to shield the bolt actuator part from an exterior face of the closure member, the spindle axis being non-aligned with said bolt actuator part,
- each rotatable carrier plate has an arcuate (preferably circular) array of openings centred on the spindle axis,
- each of said openings is selectively engageable by a selector pin that is rotatable by depressible dial means, and
- each carrier plate has an aperture therethrough, said apertures being equi-spaced radially from the spindle axis,
- an insert in each said aperture is slidable laterally of the associated carrier plate and, with carrier plate rotation, is rotatable into alignment with the bolt actuator part, each insert being expressible laterally from its associated carrier plate when (and only when) all the inserts are in said alignment with the bolt actuator part whereby the insert nearest to the bolt actuator part can engage it and cause movement of the bolt to its said release condition.

Preferably the bolt actuator part comprises a chamfered face of the bolt.

Advantageously each carrier plate comprises a disc.

Preferably each slidable insert comprises a plug fitting closely in the aperture of that carrier plate. Each said aperture may be a circular hole and the insert may then be in the form of a plug matingly slidable therein.

Advantageously the carrier plates are urged by gravity to adopt a rest position in which not all of the inserts are in alignment with one another.

In one preferred arrangement each of the carrier plates carries a weight, selectively located in relation to the insert in that carrier plate, to urge the carrier plates by gravity towards a rest position in which not all of the inserts are in alignment with one another.

Alternatively or additionally the carrier plates are urged by a magnetic effect to adopt a rest position in which not all of the inserts are in alignment with one another. Said magnetic effect may, for example, be derived from a permanent magnet located adjacent the periphery of each carrier plate and cooperating with magnetically permeable material selectively located in relation to the insert in each carrier plate.

Preferably, when the depressible dial means is in a non-depressed, rest position, said selector pin is out of engagement of any carrier plate thereby permitting each carrier plate to move into its rest position.

Advantageously the position of a carrier plate's insert relative to that carrier plate's rest position is selectable to any one of a plurality of predetermined positions of which each is identified by an associated one of a plurality of different symbols marked on the periphery of the carrier plate. The plurality of different symbols may comprise the letters of the alphabet and/or may comprise a numerical sequence (e.g. the numbers 0 to 9). Optionally the plurality of different symbols comprises a datum symbol, e.g. a hyphen or dash, to signify a datum position. The latter preferably corresponds to the position attained by the carrier plate when the weight is lowermost.

In a preferred embodiment, the combination lock comprises a bolt which is withdrawn by depressing a bolt pin which is shielded by rotating discs each having a movable disc pin within them. A selector pin attached to dial means is provided for engaging in selector holes in the discs and aligning the disc pins with one another and with the bolt pin, means being provided for pushing inwardly the disc pin on the outer disc and urging the other disc pins aligned therewith towards the bolt pin such that it is depressed and/or withdrawn. The discs have a weight attached at their circumference such that, during code setting, changing the position of the weight changes the relative angular position of the disc pin. When pressure is released from the mechanism, springs return the selector pin and the disc pins to their original positions and the weights on the discs fall, thereby rotating the discs and automatically scrambling the code.

BRIEF DESCRIPTION OF THE DRAWINGS

By way of example one embodiment of this invention will now be described with reference to the accompanying drawings of which.

DETAILED DESCRIPTION OF EXAMPLE(S) OF THE INVENTION

Figure 1:
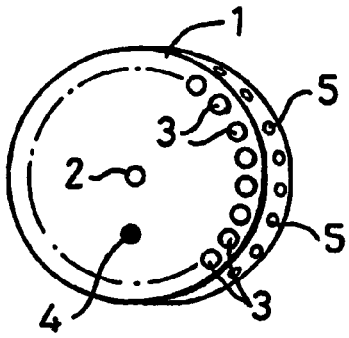
FIG. 1 is a schematic perspective view of a carrier plate of FIG. 2.

FIG. 1 shows a disc 1 with a hole through its centre 2; 27 holes, equally spaced near the circumference (referred to as "selector holes" 3); and a hole between the centre and a selector hole into which is inserted a close-fitting plug or pin 4 ("disc pin") whose length is exactly the same as the thickness of the disc—thus the ends of the pin lie flush with the sides of the disc. This pin is movable, so that when it is pushed from one direction towards a bolt pin 9 (FIG. 2) it projects from the opposite side of the disc 1. However, when the lock is in its rest condition, each pin is prevented from moving out of the disc in the opposite direction (away from the bolt pin 9), e.g. by providing for at least the pin in the first disc I and/or the last disc IV to be of somewhat conical shape and inserted in a matingly conical aperture in said disc(s).

A side view of the disc's thickness shows 27 shallow cavities 5 around the outer circumference. Each of these cavities is aligned with a selector hole 3. A weight 7 with a ferrous or magnetically permeable tip is located in one of these cavities (FIG. 2), for example, by means of a screw or a press stud.

Figure 2:
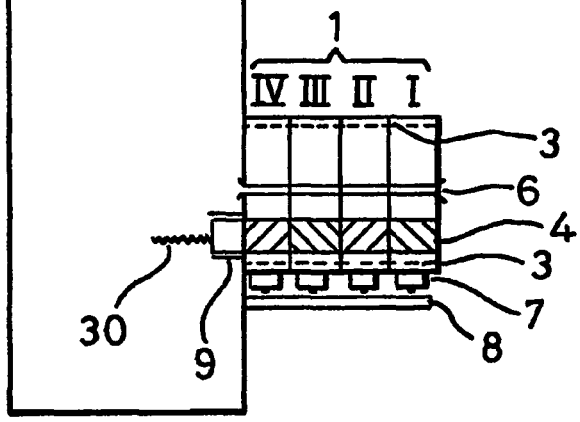
FIG. 2 is a schematic side view of parts of a combination lock according to the present invention in a rest condition.

FIG. 2 shows four identical discs 1 (referenced I, II, III, IV) mounted on a hollow rod 6. One end of rod 6 fits into the side of the lock where the bolt pin 9 is situated, the bolt pin 9 being urged towards the discs by a compression spring 30. The other end of the rod 6 has a lip that retains the discs 1 so that the sides of the discs touch one another yet they are able to rotate freely. The rod 6 is so fitted that when the discs are rotated, at a certain point the disc pins 4 will be exactly aligned with one another and with the bolt pin 9. However, when the lock is in its rest condition, the weight 7 attached to the outer circumference urges each disc to move angularly about the axis of rod 6 so that the weight lies at rest vertically below the disc axis and all the weights are in line.

Projecting from the side of the lock is a magnet 8 which extends just below all four discs. This ensures that the weights fall to exactly the same position, and therefore that, in their rest positions, the disc pins 4 are not all in alignment with one another and the bolt pin 9. If none of the elements of the code are the same, i.e. they all correspond to different symbols, then it can be said that, in their rest positions, the disc pins 4 are always out of alignment with one another and the bolt pin 9. The magnetic attraction also counters any tendency for one rotating disc to move a neighbouring disc through friction. Optionally, friction may be reduced by hollowing out non-essential areas of the disc, and covering touching parts with p.t.f.e. or some other friction-reducing and/or non-stick material.

Figure 3:
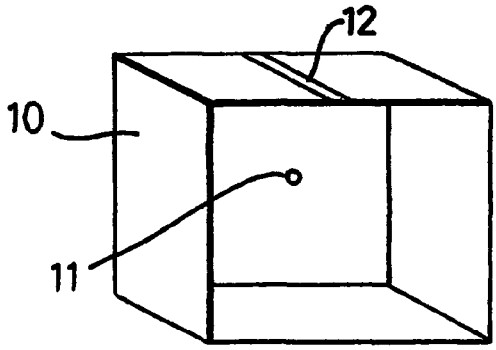
FIG. 3 is a schematic perspective view of a further part of the same combination lock according to the present invention.

FIG. 3 shows the external section of the lock which is mounted on the outer side of the door 19 or other closure member for the doorway or other opening. It is composed of an opaque box 10 which is open at one end and which has a small hole at the centre of the opposite end 11. Along the centre of the top side of the box, extending from the door to the open side, is a narrow transparent slit-like window or gap 12.

Figure 4:
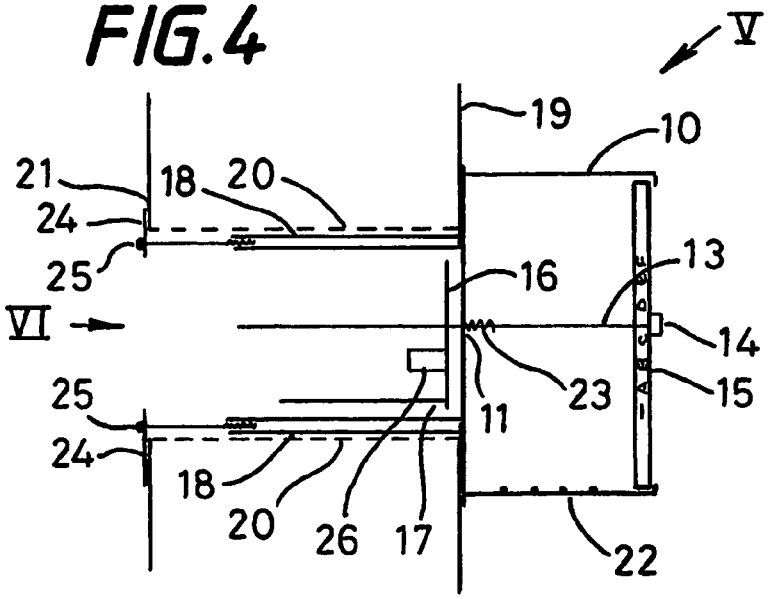
FIG. 4 is an enlarged schematic side view of parts of the combination lock of FIGS. 2 and 3 illustrating the manner of installation.

FIG. 4 shows the outer box section 10 of the lock mounted on the outside of the door 19 and overlapping a hole cut through the door (represented by the area between the two broken lines 20), so that the lock cannot be pushed inwards. A spindle 13 is inserted through the bole in the box 11, and into the hollow rod 6 to be rotatably mounted by it. A knob 14 is provided on the outer end of spindle 13 such that the spindle 13 can be rotated by turning the knob, and it can also be pushed inwards and pulled outwards. A dial 15 attached to the outer end of spindle 13 is located immediately rearwardly of knob 14. This dial is a disc having the letters of the alphabet and a hyphen or dash marked sequentially around its thick outer circumference, in this example in anticlockwise sequence. Further along the spindle, just before the hole in the box, is a coiled compression spring 23.

Fixed to spindle 13 beyond the hole in the box (i e within the hole in the door 19) is a thin disc 16 from which projects a pin 17 pointing away from the box. This pin can pass through any selected one of the selector holes in the discs 1 and is referred to as the "selector pin".

On the floor of the box are four humps 22 over which the bottom of the dial 15 moves when the spindle is pushed inwards. These humps, which act as detents, are so spaced that they provide a positional indication to the user when each sequential disc 1 has been penetrated by the selector pin 17. Between the selector pin 17 and the spindle 13 is a protruding pin 26 (referred to as the "action initiating pin") which is so positioned that when appropriately aligned and it is pushed longitudinally inwards it pushes the disc pins (see FIG. 8).

Also, on this outer side of the box (within the door hole) are two narrow blocks 18 parallel to one another with one on each side of the spindle, and having tapped holes at their ends. On the inside of the door 21 there is attached a plate 24 (see FIG. 6) through which two screws 25 are inserted into the narrow blocks 18, thereby fixing the lock securely.

Figure 5:
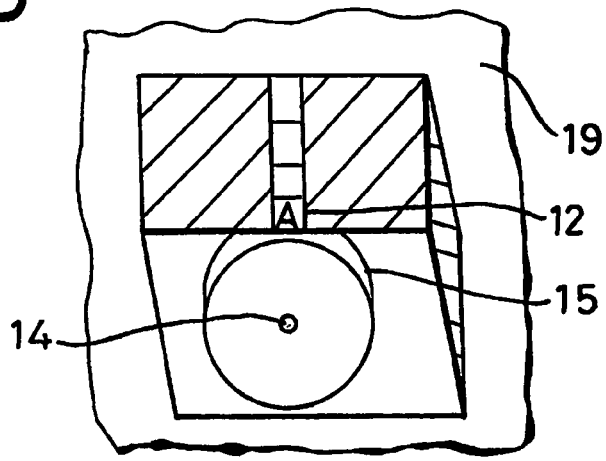
FIG. 5 is an enlarged schematic perspective view in the direction of arrow V of FIG. 4.

FIG. 5 represents the outer box as viewed by the user of the lock. When the knob 14 at the end of the spindle is turned, the letters on the dial 15 rotate and one character at a time appears in the transparent slit-like window or gap 12. This slit-like window or gap is marked into four sectors so that the user can know which disc 1 (I, II, III or IV) is being rotated.

Figure 6:
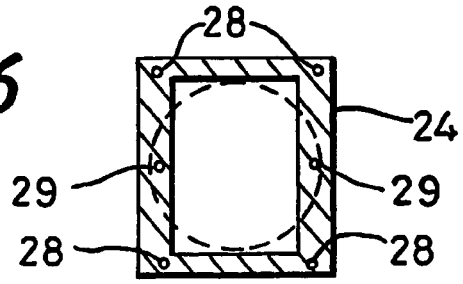
FIG. 6 is an enlarged schematic perspective view in the direction of arrow VI of FIG. 4.

FIG. 6 shows the retaining plate 24 which fits over the hole (represented by the broken circle) on the inner side of the door. The plate is fixed to the door by screws or nails which fit through the holes 28, and screws are inserted through the holes 29 into the narrow blocks 18.

Figure 7:
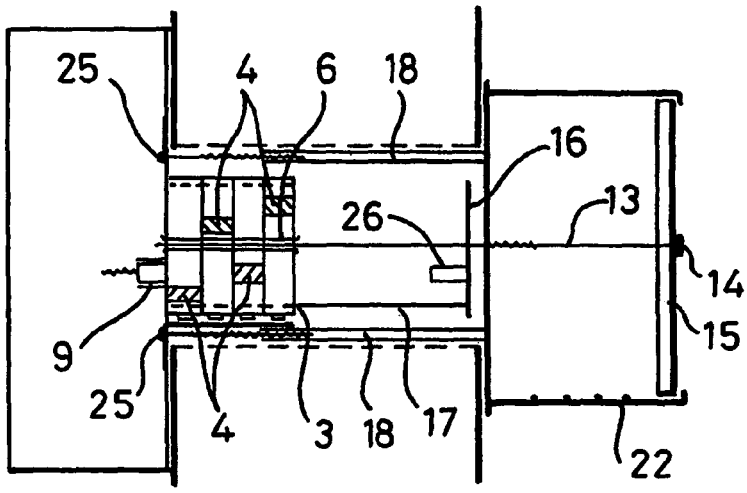
FIG. 7 is an enlarged schematic side view of the installed combination lock of FIGS. 2 and 3 and showing additional parts.

FIG. 7 shows the assembled lock mounted on the door. The spindle 13 is fully withdrawn, the disc pins 4 are scrambled and the bolt pin 9 is in the "closed" position.

Figure 8:
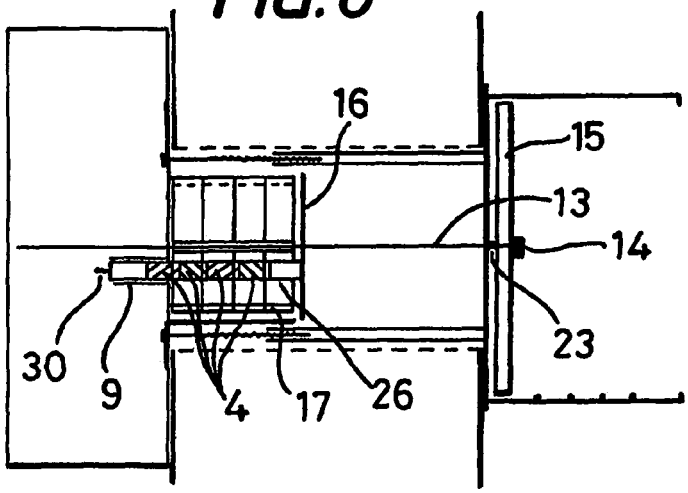
FIG. 8 is a similar view to that of FIG. 7 but with the lock in an unlocking position.

FIG. 8 shows the assembled lock with the spindle 13 pressed in and the action initiating pin 26 pressing the disc pins 4 through the disc chambers, thereby depressing the bolt pin 9. Springs 30 and 23 return the bolt pin and the dial 15 to their original positions (as in FIG. 7) when the external force is removed.

Figure 9:
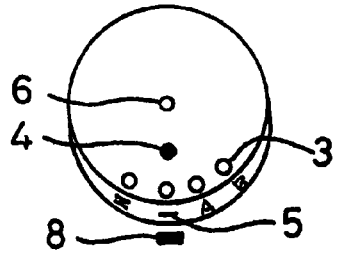
FIGS. 9 to 12 are views similar to FIG. 1 showing alternative arrangements of the carrier plates and of pin locations provided by the carrier plates.
Figure 10:
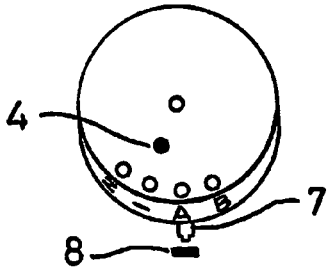

FIGS. 9 and 10 indicate how the location of the weight 7 at a different point on the disc circumference alters the position of the disc pin.

Figure 11:
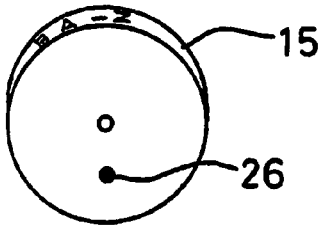
Figure 12:
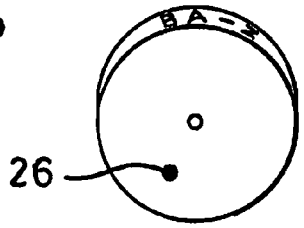

FIGS. 11 and 12 indicate how the lock dial 15 enables the disc pins to be aligned with the action initiating pin 26. The action initiating pin is not part of the lock dial 15 but is attached to a disc 16 which is fixed to the spindle 13 and moves exactly in accordance with the dial 15. Thus the representation of the action initiating pin in the diagram indicates its position on the disc.

Before installation and first use, the initial requirement is to set the code. With reference to FIG. 9, the cavity 5 on the disc circumference relating to the pin 4 is marked with the symbol of a dash or hyphen. (That is to say, the cavity nearest the pin and lying at a right angle to a line extending through the disc centre, pin and selector hole). Moving anti-clockwise, the next cavity is marked 'A', the next 'B' and so on until coming full circle to 'Z' which is next to the dash or hyphen symbol. The discs are rotated on the rod 6 so that the dash is positioned just above the magnet 8. Now if a weight 7 is attached to cavity 'A', the weight will fall to the perpendicular and thus the disc will rotate clockwise, so that the dash, and therefore the disc pin will move one hole clockwise (FIG. 10). If the weight were attached to 'B' the movement would be two holes clockwise, and so on. Thus the position of the disc pin 4 relative to the vertical is determined by the cavity to which the weight is attached, and the alphabetic code can be selected by attaching the weight to the appropriate cavity on each of discs I, II, III and IV.

Having set the code, the lock is assembled on the door 19. A hole is cut through the door's thickness and the box section is inserted from the outer face of the door (FIG. 4) so that the slit-like window or gap 12 faces upward (FIG. 5). The retaining plate 24 (FIG. 6) is screwed in place over the hole on the inner face of the door 21 and screws 25 are inserted through its holes 29 into the two narrow blocks 18, so that the box section of the lock is clamped to the door. The bolt mechanism from which protrude the discs mounted on the hollow rod (FIG. 2) is then fixed to the inner face of the door so that the spindle 13 extending from the lock dial 15 lies within the hollow rod 6 (FIG. 7). The knob 14 is pulled outwards so that the selector pin 17 is not touching the first disc 1. This allows the discs to rotate unrestrained under the effect of the weights and the magnet until the weights lie adjacent one another vertically below the rod's axis and the code is thereby scrambled.

In the conventional manner, the bolt pin 9 has a chamfered face (not shown) which, when depressed, results in the bolt being retracted. When the code has been set and the lock installed, this chamfered face of the bolt pin is shielded by the four discs (FIG. 7). The only way to open the lock is to align the disc pins 4 with the bolt pin 9, and the pin 26 with the disc pins. The position of the bolt pin can be common to all locks and is therefore known—it will be assumed to be at 6 o'clock. The lock dial 15 is marked anti-clockwise from the dash with the letters of the alphabet (FIG. 11). Accordingly, when that a letter is displayed and visible through window 12 (FIG. 5) and the dial knob 14 is pressed inwards, the selector pin 17 will always move into a periphery-adjacent disc hole 3. When the dash is displayed (at 12 o'clock on the dial) the action initiating pin 26 is so located on its disc 16 that it lies at 6 o'clock and is thereby aligned with the bolt pin. If, say, the code on the first disc I has been set to correspond to the letter 'A', then the disc pin 4 lies one position clockwise of 6 o'clock (FIG. 10). Therefore, if the lock dial is turned clockwise to 'A', the action initiating pin 26 will move one letter-spacing clockwise and will be aligned with the disc pin 4 (FIG. 12). The knob 14 is then pressed in until it meets the resistance of the first detent 22, and at this point the selector pin 17 will have entered a perimeter-adjacent hole 3 in the first disc I. If the code on the second disc II has been set to 'B', then the disc dial 15 has to be turned to 'B' so that the pin press 26 and the disc pin 4 in the first disc I will be aligned with the disc pin 4 in the second disc II. The knob 14 is pressed in again until it meets the resistance of the second detent 22. Similarly the position of the disc pins 4 in the other discs III and IV can be located by turning the dial 15 to the requisite letter visible in window 12 and pressing the knob 14 to engage the relevant disc.

When the action initiating pin 26 and the pins 4 on all the discs I-IV are aligned, the dial 15 is turned to portray the dash (or hyphen) symbol in the window 12 whereby all the pins 4 become aligned with the bolt pin 9. The knob 14 is pushed in further thereby engaging cammingly the chamfered surface of the bolt pin 9 via the now-aligned disc pins 4 and thereby effecting withdrawal of the bolt pin (FIG. 8) against the action of the coiled compression spring 30. As pressure on the knob is released, the return spring 30 urges return of the bolt pin 9 and, via its camming chamfered surface, pushes the disc pins 4 back into their original positions. At the same time, the coiled return spring 23 (which had been compressed when the dial 15 was pushed against it) is released and pushes the dial 15 back to its original position, thereby withdrawing the selector pin 17 from the selector holes 3 in the discs. When thus at rest, the bolt pin 9 exerts no lateral pressure on the disc pins 4 so the weight 7 on each disc's circumference falls freely and arcuately about the disc's rotational axis until stabilized by the magnet, and the code is thus automatically reset to its scrambled condition.

The illustrated lock, as described above, overcomes some of the problems associated with traditional combination locks. Firstly, the number of combinations on the four discs—with each having a symbol code of 27 positions (corresponding to the letters of the Roman alphabet plus a dash or hyphen) is 531,441 so the possibility of the code being discovered by chance is very remote (or would be extremely time consuming). Of course, the number of combinations can be increased enormously by increasing the number of discs. Secondly, because the user turns a small knob rather than pressing keys or buttons, and since the letter symbol on the lock dial 15 (and visible in the strip-like window 12) can be readily shielded from view during use, it is almost impossible for an observer to detect the code combination. Thirdly, the use of the alphabet allows the formation of a mnemonic for the code and mitigates the problem of forgetting the code or transposing code characters. For example, it is much easier to remember a four-lettered word such as 'five' than a sequence of four numbers 5924. Furthermore, the provision of a hyphen or dash in the available symbols facilitates the use of 1-, 2- or 3-letter words.

Furthermore, the lock is able to accommodate both the requirement to provide security for premises and also to control access. For instance, one might want staff to be able to enter a building during the day but not at night. To achieve this, one could increase the number of discs to for example six and then set a 6-symbol code. The lock is opened using this 6-symbol code by aligning all the disc pins 4 with one another and with the bolt pin 9. From the inner side of the lock, a pin is pressed through a selector hole in the first four discs nearest the bolt, thereby fixing them in the "lock open" position. The knob 14 is then released so that the bolt pin 9 pushes the pins 4 back into their discs and the selector pin 17 moves out away from all of the discs 1. Only the two unfixed discs, being free and unconstrained, are able to rotate and be automatically scrambled. The code for these two discs is provided to the staff so they can gain entry during the day. At the end of the day, the person entrusted with securing the premises pulls out the interior securing pin and the other four discs become automatically scrambled. Now, only someone knowing the correct 6-symbol code appropriate for all six discs can open the lock.

Unlike keyed locks which can be picked, combination locks can only be opened by entering the correct code. However, on some prior art combination locks it is possible to manipulate the working parts so as to discover the code. With the above-described and illustrated combination lock, the only contact between the user and the disc pins 4 is when the action initiating pin 26 is pressed against the first disc 1. If it were possible to detect a movement, vibration or distinctive sound when the action initiating pin 26 hit the disc pin 4, then its location could be identified. If the pin 4 is made of the same material as the disc 1 and fits perfectly within its chamber (in the manner of a sliding plug), the impact of the action initiating pin 26 upon it should produce no different an effect than if it hit any other point on the disc 1. However, if necessary, simple measures can be taken to camouflage any possible distinctive effect of striking the disc pin 4. For example, the end of the pressing pin 26 could be padded, or it could have a movable head so that at the point of impact the impact sensation would be masked. Another arrangement could be for each disc 1 to have twenty-seven identical pins of which only one was able to move out of its chamber.

Although the illustrated embodiment requires that the disc pins 4 are in alignment with one another and also with the bolt pin 9 to effect lock release operation of the bolt pin 9, an alternative arrangement is envisaged in which the bolt pin 9 is located on the rotational axis (or with its chamfered face across the rotational axis). With such an alternative construction, lock release would be effected by engagement of the bolt (or its chamfered face) by the free end of spindle 13 when that executes its last indexed longitudinal motion which is enabled by the pin 4 of the last disc IV (FIG. 2) moving outwards from that disc (into a free space provided to accommodate it).

It will also be appreciated that the present invention is not limited to the provision of a combination lock to control opening of a closure member such as a door, window or the like. For example a combination lock according to this invention may be utilised for actuation of a latch or even potentially for a padlock. For example, in a padlock according to this invention, the shackle could be held captive by a laterally movable release lever that is actuated to move sideways and effect shackle release by a control mechanism substantially as illustrated. For this, the control mechanism incorporates carrier means—comprising rotatable carrier plates or discs 1 each with a weight 7 (optionally magnetically permeable) selectively positioned thereon relative to the insert 4 of that carrier plate—the carrier means being rotatably mounted on a horizontal hollow rod 6 in which the spindle 13 of the depressible dial means is slidable mounted. When they are all in mutual alignment, the inserts 4 can engage directly against the laterally movable release lever of the padlock. Alternatively, the laterally movable release lever may be in alignment with the spindle's rotational axis and such as to be actuated by the last indexed longitudinal motion of the spindle 13 (when the inserts 4 are all in mutual alignment).

It will be appreciated that, with each of the above-described embodiments of this invention, there is a single operating dial 15, provided with a sequence of code symbols about its periphery, which is operably common to all of the plurality (N) of rotatable carrier means (1,4,7). This single operating dial 15 operates irrespective of the direction of rotation employed, via selector pin 17, upon each of the N carrier means in sequence and, after moving each such carrier means arcuately to its pre-set, selected code position, is indexed longitudinally of the rotation axis. Non-detectable mutual alignment of all the inserts is thus obtained (in which position the full code is represented), the last indexed longitudinal motion of the dial 15 causing all of the thus-aligned inserts to be expressed in a direction outwardly of their respective carrier means thereby then, and only then, effecting or permitting releasing actuation of the locking member (such as bolt 9). As stated above, such releasing actuation of the locking member can be effected directly by the expressed insert of the $N^{th}$ carrier means or can be effected directly by the spindle or shaft 13 extending axially of the single operating dial 15 and moving therewith in said indexed fashion.

Other modifications and embodiments of the invention, which will be readily apparent to those skilled in this art, are to be deemed within the ambit and scope of the invention, and the particular embodiment(s) hereinbefore described may be varied in construction and detail, e.g. interchanging (where appropriate or desired) different features of each, without departing from the scope of the patent monopoly sought by the following claims.

The invention claimed is:

1. A combination lock comprising a coded control mechanism to release a locking member from its locked condition, wherein the coded control mechanism comprises:

a plurality of rotatable carrier means with a rotational axis, each carrier means comprising a rotatable carrier plate having an arcuate array of openings centred on the rotational axis, each of said openings being selectively engageable by a selector pin that is rotatable by depressible dial means, the progressive depression and rotation of which effects engagement of the selector pin with a said opening in progressively each of the rotatable carrier plates, characterized in that each carrier plate has an aperture therethrough, said apertures being equi-spaced radially from said rotational axis, an insert in each said aperture is slidable laterally of the associated carrier plate and is expressible laterally from its associated carrier plate when and only when all the inserts attain a state in which they are in mutual alignment, the attainment of said state enabling the control mechanism to operate on the locking member and effect its release from the locked condition.

2. A combination lock according to claim 1, wherein the rotatable carrier means further comprises a weight located on or adjacent to the periphery of each carrier plate to urge it by gravity towards a rest position in which the weight is lowermost, the position of each weight being selectively variable in relation to the aperture in its associated carrier plate thereby enabling that carrier means to provide one distinctive element of a code and the plurality of carrier means to provide the whole of the selected code.

3. A combination lock according to claim 2, wherein the weights comprise elements of magnetically permeable material and the lock comprises a permanent magnet beneath the plurality of carrier means to aid the attainment of a rest position with all the weights lowermost.

4. A combination lock according to claim 2, wherein the carrier means comprises elements of magnetically permeable material separate from the weights, and with a permanent magnet located appropriately in relation to said elements as to ensure the plurality of carrier means can attain said rest position with all the weights lowermost.

5. A combination lock according to claim 2, wherein the code set for the lock is readily alterable by moving said weights into alternative positions relative to said inserts.

6. A combination lock according to claim 4, wherein the code set for the lock is readily alterable by moving said weights into alternative positions relative to said inserts.

7. A combination lock to control opening of a closure member, and comprising a bolt movable from a locking position to a release position and including a bolt actuator part, the combination lock being characterised by a plurality of carrier plates mounted rotatably upon a spindle such as to shield the bolt actuator part from an exterior face of the closure member, the spindle being on an axis non-aligned with said bolt actuator part, each rotatable carrier plate having an arcuate array of openings centred on the spindle axis, each of said openings being selectively engageable by a selector pin that is rotatable by depressible dial means, the progressive depression and rotation of which effects engagement of the selector pin with a said opening in progressively each of the rotatable carrier plates, and characterized in that each carrier plate has an aperture therethrough, said apertures being equi-spaced radially from the spindle axis, an insert in each said aperture is slidable laterally of the associated carrier plate and, with carrier plate rotation, is rotatable into alignment with the bolt actuator part, each insert being expressible laterally from its associated carrier plate when and only when all the inserts are in said alignment with the bolt actuator part whereby the insert nearest to the bolt actuator part can engage it and cause movement of the bolt to its said release position.

8. A combination lock according to claim 7, wherein the bolt actuator part comprises a face of the bolt.

9. A combination lock according to claim 7, wherein each carrier plate comprises a disc.

10. A combination lock according to claim 7, wherein each slidable insert comprises a plug fitting closely in the aperture of that carrier plate.

11. A combination lock according to claim 7, wherein each said aperture is a circular hole and the insert is in the form of a plug matingly slidable therein.

12. A combination lock according to claim 7, wherein the carrier plates are urged by gravity to adopt a rest position in which not all of the inserts are in alignment with one another.

13. A combination lock according to claim 7, wherein each of the carrier plates carries a weight, selectively located in relation to the insert in that carrier plate, to urge the carrier plates by gravity towards a rest position, in which not all of the inserts are in alignment with one another.

14. A combination lock according to claim 13, wherein the code set for the lock is readily alterable by moving said weights into alternative positions relative to said inserts.

15. A combination lock according to claim 7, wherein the carrier plates are urged by a magnetic effect to adopt a rest position in which not all of the inserts are in alignment with one another.

16. A combination lock according to claim 15, wherein said magnetic effect is derived from a permanent magnet located adjacent the periphery of each carrier plate and cooperating with magnetically permeable material selectively located in relation to the insert in each carrier plate.

17. A combination lock according to claim 7, wherein, when the depressible dial means is in a non-depressed, rest position, said selector pin is out of engagement of any carrier plate thereby permitting each carrier plate to move into a rest position.

18. A combination lock according to claim 7, wherein the position of a carrier plate's insert relative to that carrier plate's rest position is selectable to any one of a plurality of predetermined positions each of which is identified by an associated one of a plurality of different symbols marked on the periphery of the carrier plate.

19. A combination lock according to claim 18, wherein the plurality of different symbols comprises the letters of the alphabet.

20. A combination lock according to claim 18, wherein the plurality of different symbols comprises a numerical sequence.

21. A combination lock according to claim 18, wherein the plurality of different symbols comprises a datum symbol to signify a datum position.

22. A combination lock according to claim 9, wherein each of the carrier plates carries a weight, selectively located in relation to the insert in that carrier plate, to urge the carrier plates by gravity towards a rest position, in which not all of the inserts are in alignment with one another.

23. A combination lock according to claim 10, wherein each of the carrier plates carries a weight, selectively located in relation to the insert in that carrier plate, to urge the carrier plates by gravity towards a rest position, in which not all of the inserts are in alignment with one another.

24. A combination lock according to claim 12, wherein each of the carrier plates carries a weight, selectively located in relation to the insert in that carrier plate, to urge the carrier plates by gravity towards a rest position, in which not all of the inserts are in alignment with one another.

25. A combination lock according to claim 10, wherein when the depressible dial means is in a non-depressed, rest position, said selector pin is out of engagement of any carrier plate thereby permitting each carrier plate to move into its a rest position.

26. A combination lock according to claim 13, wherein when the depressible dial means is in a non-depressed, rest position, said selector pin is out of engagement of any carrier plate thereby permitting each carrier plate to move into its a rest position.

27. A combination lock according to claim 10, wherein the position of a carrier plate's insert relative to that carrier plate's rest position is selectable to any one of a plurality of predetermined positions each of which is identified by an associated one of a plurality of different symbols marked on the periphery of the carrier plate.

28. A combination lock according to claim 13, wherein the position of a carrier plate's insert relative to that carrier plate's rest position is selectable to any one of a plurality of predetermined positions each of which is identified by an associated one of a plurality of different symbols marked on the periphery of the carrier plate.

* * * * *